United States Patent [19]

Ciletti et al.

[11] Patent Number: 4,694,668

[45] Date of Patent: Sep. 22, 1987

[54] SECURITY BOX

[76] Inventors: Guy D. Ciletti; Michael J. Trudeau, both of 7 Princeton, Irvine, Calif. 92720

[21] Appl. No.: 920,393

[22] Filed: Oct. 24, 1986

[51] Int. Cl.[4] ..... E05B 65/52

[52] U.S. Cl. ..... 70/63; 107/50

[58] Field of Search ..... 70/63, 57, 58; 109/13, 109/45, 49, 50, 51, 52, 68; 248/551, 552, 553; 211/4–8

[56] References Cited

U.S. PATENT DOCUMENTS

| | | | |
|---|---|---|---|
| 3,146,739 | 9/1964 | Furman | 109/52 |
| 3,742,741 | 7/1973 | Cahan | 70/63 |
| 3,744,281 | 7/1973 | Logue | 70/58 |
| 3,927,792 | 12/1975 | Andrade | 109/52 |
| 3,934,434 | 1/1976 | Law | 70/63 |
| 4,112,717 | 9/1978 | Bradley | 70/63 |
| 4,244,304 | 1/1981 | Read | 109/52 |
| 4,462,317 | 7/1984 | Franko | 109/45 |

*Primary Examiner*—Robert L. Wolfe

*Attorney, Agent, or Firm*—Weissenberger & Peterson

[57] ABSTRACT

A device in which to place an article to be retrieved later by an intended recipient employs a container having a forward portion defining a first opening through which to insert an article, a rearward portion defining a second opening through which to retrieve the article, and a size and shape enabling the container to be mounted on a conventional door. The device includes a lockable cover member for limiting access through the first opening, and a bracket for supporting the container adjacent the door by closing the door with the bracket between the door and door frame. The bracket is attached to the container to support the container in a position enabling cover removal for access through the first opening while retaining the rearward portion closely adjacent the door to inhibit access through the second opening. A lip portion of the bracket member engages the door to inhibit removal when the door is closed while enabling removal when the door is open, to thereby enable an intended recipient to retrieve an article by opening the door and removing the container to a position providing access through the second opening.

11 Claims, 4 Drawing Figures

SECURITY BOX

BACKGROUND OF THE INVENTION

1. Technical Field

This invention relates generally to security devices, and more particularly to a lockable box in which to place an article for later retrieval by the intended recipient.

2. Background Information

Many existing devices are designed to facilitate delivery in the absence of the intended recipient. Mail chutes, milk boxes, and payment depositories list just a few. They provide an arrangement whereby an article can be left at the delivery site for retrieval by the intended recipient at a later time, and they are commonly used for many home delivery applications.

Some applications require a better delivery arrangement, however. Consider, for example, the home delivery of video cassettes to a user. Video cassettes are often delivered to a user's home during the day, while the user is at work or otherwise absent. The cassettes are viewed when the user returns, often during the evening hours, and they are left for the delivery service to pick up the following day. The delivery service picks them up, and at the same time fills any new video cassette orders.

This video cassette delivery procedure imposes certain requirements not adequately satisfied by existing delivery arrangements. First, the cassettes are somewhat fragile, and it would be unwise to drop them through a mail chute. They might become damaged in the fall, or abused upon the floor or in the receptacle into which they fall. Therefore, it is desirable to have a device in which a cassette can be placed and stored safely until the user arrives.

Also, video cassettes left unsecured often invite theft, and it is preferred that they be delivered in some manner that overcomes this concern. A covered box on the user's doorstep, such as a typical milk box, provides an enclosure, but it is easily entered by unauthorized persons, and does not solve the problem. Therefore, it is desirable to have a device that can be locked, to limit access to authorized persons and inhibit theft of the cassette.

Although a locked depository would inhibit theft, existing locked depositories are often inconvenient for several reasons. Using a key operated lock often requires that several copies of the key be made, separate ones for use by the supplier, the user, and for backup purposes in the event a key becomes lost. Although the supplier might use a master key, this arrangement still involves a different key for each user, and the risk and inconvenience of key loss. Other locking arrangements, such as combination locks, have similar drawbacks. Thus, it is desirable to have a lockable container that foregoes the need for the intended recipient to have a key or remember a combination to gain access.

In addition, it is often desirable that the supplier be able to provide a suitable device to a prospective customer of the delivery service—a device that is readily used at the home or other delivery site without inconvenient installation requirements. Consequently, it is desirable to have a new and improved device for delivery applications that satisfies this need also.

SUMMARY OF THE INVENTION

Briefly, the above and further objects of the present invention are realized by providing a new and improved device in which to place an article for delivery purposes.

The device employs a container having a forward portion that defines a first opening through which to insert an article into the container, a rearward portion that defines a second opening through which to retrieve the article, and a size and shape enabling the container to be mounted on a conventional door. In one embodiment of the invention, the container takes the form of a video cassette-size box in which to make home deliveries, and in another, a door mounted cabinet in which to receive medicinal supplies.

A front cover member is included. The front cover member is adapted to be locked in place over the first opening to limit access to the container interior through the first opening. It may be a removable cover that includes a key operated lock, for example.

A bracket member is provided that has a generally flat midportion shaped and dimensioned to fit between a door and the door frame. It is used to support the container by closing the door with the midportion disposed between the door and door frame. In one embodiment, the bracket member is a rigid plate suitably attached to the container.

One end of the bracket is attached to the container to position the container adjacent the door. It is attached so that with the bracket midportion disposed between the door and the door frame, the first opening of the container is disposed in a position enabling placement of an article through the first opening by unlocking the first cover member. In addition, the second opening of the container is disposed closely adjacent to and facing the door in a position inhibiting retrieval of the article through the second opening.

A lip portion of the bracket member, disposed intermediate the midportion and the other end of the bracket, engages the door to inhibit removal of the container when the door is closed while enabling removal when the door is open. Therefore, the intended recipient can retrieve the article without using a key by opening the door to remove the container to a position providing access through the second opening.

Thus, the device of this invention provides a new and improved receptacle that overcomes many drawbacks of the prior art. It provides a superior receptacle in which video cassettes, medicinal supplies, and other articles can be placed and safely stored for retrieval later by the intended recipient.

In addition, it can be locked to limit access to authorized persons and inhibit theft of an article, while enabling the intended recipient to retrieve the article without using a key or combination to gain access. Furthermore, the device of this invention is readily used at the home or other delivery site without inconvenient installation requirements, and one key is all that is needed to service all of the supplier's customers.

In line with the foregoing, the principal object of the present invention is to provide a new and improved device that alleviates many drawbacks of the prior art.

It is an object to provide such a new and improved device in which a cassette, or other article, can be placed and stored safely until the intended recipient arrives and removes the article.

It is a further object to provide such a device that can be locked, to limit access to authorized persons and inhibit theft of an article placed inside, while foregoing the need for the intended recipient to have a key or remember a combination to gain access.

In addition, it is an object of the invention to provide a new and improved device that is inexpensive to manufacture and readily used at the home or other delivery sites without inconvenient installation requirements.

DESCRIPTION OF THE PREFERRED EMBODIMENTS

Figure 1:
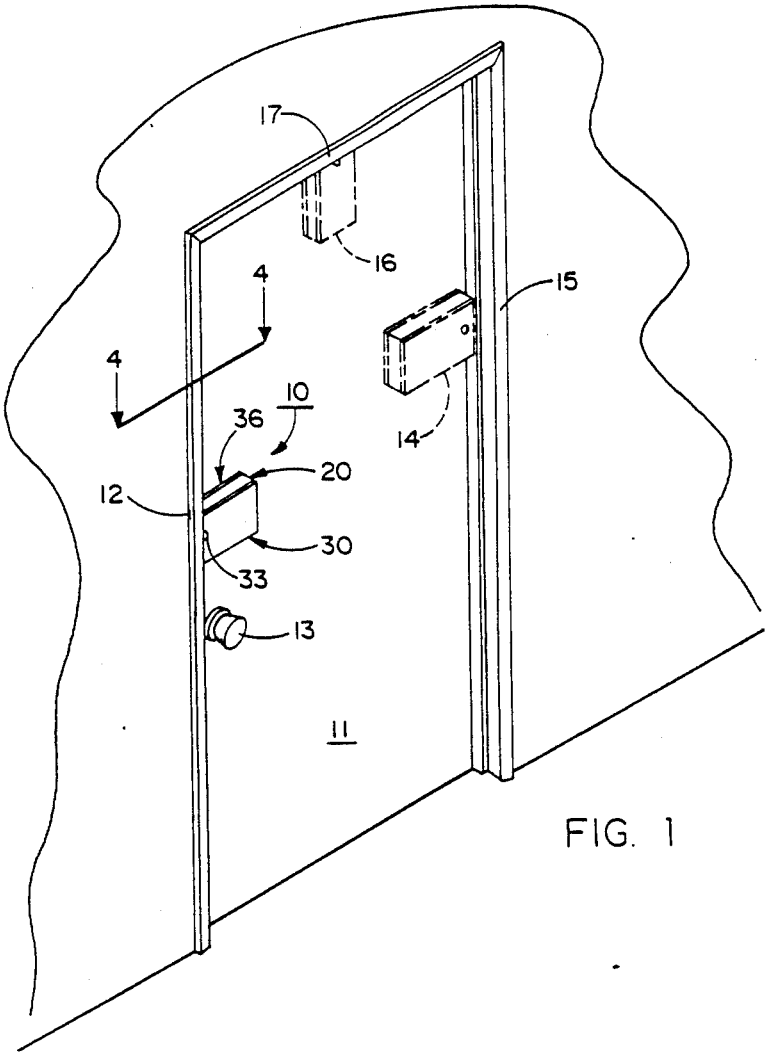
FIG. 1 of the drawings is a perspective view of the device of this invention shown mounted on the outside of a conventional door.

Referring now to the drawings, there is shown a new and improved device 10 constructed in accordance with the present invention. It is designed for use in home delivery of video cassettes, but the inventive concepts are equally applicable to other structures in which an article can be placed for retrieval later by an intended recipient.

Device 10 is shown in FIG. 1 mounted on the outside of door 11. It is mounted by closing the door against a bracket member (not visible in FIG. 1) that is disposed between the door and the door frame 12. In this position it provides a convenient device in which to place a video cassette for delivery purposes.

Although it is mounted adjacent door knob 13, the container 20 may, instead, be mounted in other positions, such as in the position shown at 14 in phantom lines adjacent door frame portion 15, or at 16 adjacent upper door frame portion 17. It can be mounted at the lower portion of the door as well, but it is mounted most advantageously immediately above a door hinge or lock mechanism. The bracket can rest atop the hinge or lock mechanism, and this prevents downward movement of the container.

Generally, the device 10 employs a container 20 in which to place an article, a lockable front cover member, first or front cover 30, with which to cover a first access opening in the container, and a rear cover member, second or rear cover 36, with which to cover a second access opening in the container. In addition, it includes a bracket member, bracket 40, for mounting the container on the door so that the container can be removed for access to an article within.

Considering first the container 20 (FIGS. 1–4), it comprises a rectangular box of suitable composition, such as sheet metal, that has a size and shape adapted to be mounted on the door 12, and receive a selected article such as cassette 21. The illustrated embodiment is approximately twenty-five centimeters long by sixteen centimeters wide and eight centimeters deep. This is a convenient size in which to place three conventional video cassettes, an ample supply for one or two days' viewing.

Figure 2:
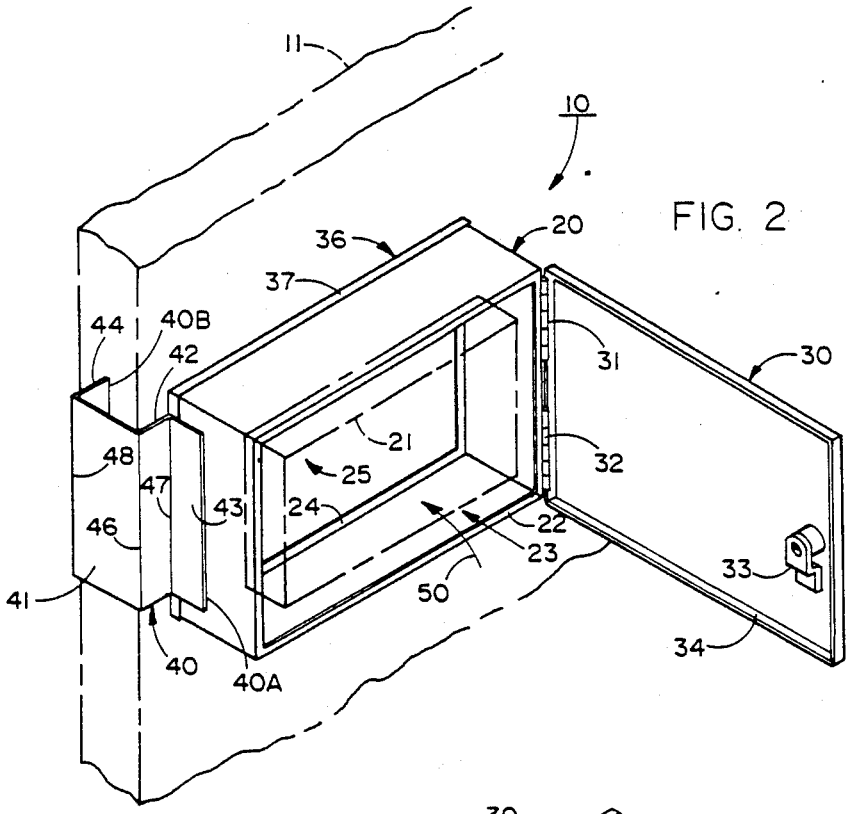
FIG. 2 is an enlarged perspective view of the device mounted on the door, with the front cover member in an open position for placement of an article inside.

The first or forward portion 22 of the container 20 defines a first or front opening 23 through which the cassette 21 is placed into the container, as depicted by arrow 50 in FIG. 2. Similarly, the second or rearward portion 24 defines a second or rear opening 25 through which the cassette is retrieved, or removed from the container, as depicted by arrow 51 in FIG. 3. Other container configurations can be employed that employ a two opening arrangement.

Front cover 30 is adapted to be locked in place over the front opening 23 to limit access to the container interior. It is fabricated from a suitable material, such as sheet metal, with a lip portion 34 that extends partially over the container to better protect the container interior.

Hinges 31 and 32 serve to attach the front cover to the container so that the cover can be moved between an open and closed position. They may be integrally formed in the container 20 and front cover 30, or attached by means such as spot welding.

Lock 33 employs a conventional key operated lock mechanism that is attached to the front cover by suitable means, such as securing it within a hole in the cover. It operates to engage the forward portion 22 of the container 20.

Rear cover 36 is adapted to be placed over the rear opening 25 to limit access to the container interior through the rear opening. Like front cover 30, it is fabricated from a material such as sheet metal and attached to the container 20 by hinges 38 and 39 so that it can be moved between open and closed positions. Unlike the front cover, it does not include a lock. Instead, the rear cover can be readily opened with little effort once the container is moved away from the door. Thus, a very convenient user access arrangement is achieved.

The bracket 40 serves to support the container 20 on the door 11. It is fabricated from suitable material, such as a section of rigid, one millimeter thick sheet metal, and it is attached to the container by suitable means, such as spot welding. A container/bracket combination of unitary construction may also be used.

Figure 4:
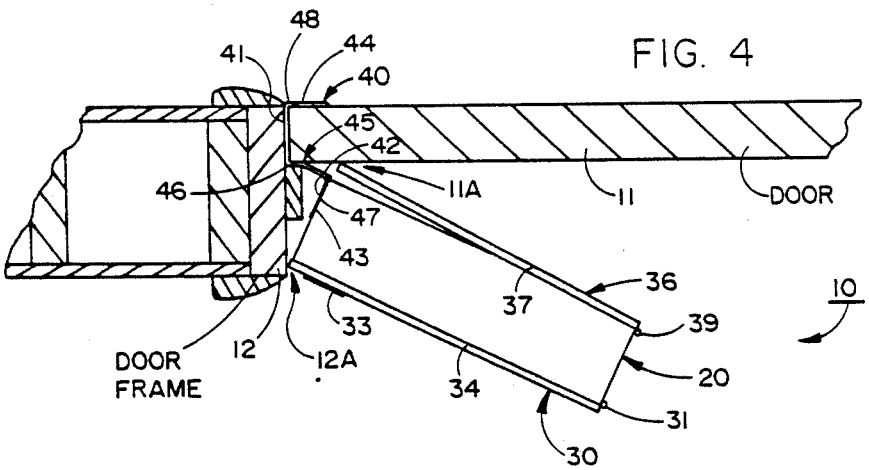
FIG. 4 is a cross sectional view taken on line 4—4 of FIG. 1, illustrating the device abutting the door frame in a position that inhibits unauthorized access through the rear opening.

The bracket 40 extends between first end 40A and second end 40B, and includes a generally flat midportion 41. This midportion is shaped and dimensioned to fit between the door 11 and the door frame 12 as illustrated (FIG. 4). With the door open, the bracket 40 is placed against the door, and then the door is closed. This retains the bracket 40 and container 20 in place, and in this sense the container is mounted on the door.

First offset portion 42 and second offset portion 43 combine to serve as bracket mounting means for attaching the bracket 40 to the container 20 and for positioning the container in the desired position adjacent the door. The first offset portion 42 is disposed intermediate a first end of the midportion defined by the right angle bend 46, and the right angle bend 47. It positions the container so that the cover 20 can be unlocked to enable placement of an article into the container, and so that the rearward portion of the container is closely adjacent the door with the second opening facing the door. This position inhibits article retrieval through the second opening. It is accomplished in the device 10 with the first offset portion 42 formed by the first right angle bend 46, but other configurations may be employed.

The second offset portion 43 of the bracket is disposed intermediate the first offset portion 42 and the first end 40A of the bracket. It is formed in the illustrated device 10 by the second right angle bend 47, and it is this portion 43 that is spot welded or otherwise suitably attached to the container.

The bracket 40 includes a lip portion 44 formed by a third right angle bend 48 in the bracket. The lip portion extends from the second end of the midportion defined by the right angle bend 48, to the second end 40B of the bracket 40. It engages an interior portion of the door 11 to prevent withdrawal of the bracket from between the door and frame, and thereby serves to inhibit removal of the container when the door is closed while still enabling removal when the door is open.

Thus, this aspect of the invention allows an intended recipient to retrieve an article, without using a key, by opening the door and moving the container to a position providing access through the second opening. A cassette, for example, is placed by the supplier in the container as illustrated in FIG. 2, and the cover 30 is locked in place using a key retained by the supplier.

Figure 3:
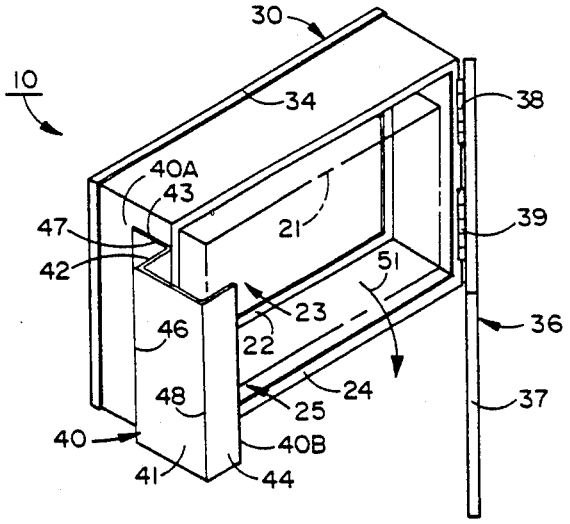
FIG. 3 is an enlarged perspective view illustrating the rear cover in an open position for retrieval of the article within.

Upon returning home, the intended recipient opens the door, removes the container to a position where the rear cover 36 can be opened, and retrieves the cassette through the rear opening as illustrated in FIG. 3. To return the cassette, the user places the cassette through the rear opening back into the container, closes the rear cover, and mounts the container on the door exterior where it is again available to the supplier.

Further details of the manner in which the device 10 inhibits unauthorized access attempts ares illustrated in FIG. 4. Suppose the end of the container 20 to which the hinges are attached is pulled away from the door manually in an attempt to gain access through the rear opening. When this is done, the device 10 moves to the position illustrated in FIG. 4. The bracket 40 must be bent to do this, as indicated by the bend at point 45, but further movement of the container is prevented by the container striking the door frame 12 at point 12A.

Thus, the rear cover can be opened only partially, since it strikes the door 11 at point 11A. The container would have to be pulled much further out from the door in order to open the rear cover, and thus access is denied. Without a key, only the most severe destruction of property, or opening the door 11, will allow access to the cassette within the container.

One change in the illustrated embodiment that further secures the container against unauthorized entry is a suitable container engaging arrangement (not shown) for securing the hinged end of the container to the door 11. This may take the form of a hook member screwed into the door that extends through a hole in the hinged end as the container is mounted on the door. It stops movement of the hinged end away from the door to further inhibit access through the rear opening. The rear cover may be omitted when this is done, to further simplify the device.

As various other changes may be made in the form, construction, and arrangement of the described components without departing from the spirit and scope of the invention and without sacrificing any of its advantages, all matter herein is to be interpreted as illustrative and not in any limiting sense.

What is claimed is:

1. A device in which to place an article to be retrieved later by an intended recipient, comprising:

a container having a first portion defining a first opening through which to insert an article into the container, a second portion defining a second opening through which to retrieve the article from the container, and a size and shape enabling the ccntainer to be mounted on a conventional door;

a first cover member adapted to be locked in place on the container in a position disposed over the first opening, to limit access through the first opening;

support means, including a bracket member having a first end, a second end, and a generally flat midportion disposed intermediate the first and second ends that is shaped and dimensioned to fit between the door and a door frame on which the door is mounted, for providing a support structure with which to mount the container on the door by closing the door with the midportion disposed between the door and the door frame;

mounting means for attaching the first end of the bracket to the container so that with the midportion of the bracket disposed between the door and the door frame, the first opening of the container is disposed in a position enabling placement of an article through the first opening by unlocking the first cover member, and the second opening of the container is disposed closely adjacent to and facing the door in a position inhibiting retrieval of the article through the second opening; and door engaging means, including a lip portion of the bracket member disposed intermediate the midportion of the bracket and the second end, for engaging the door to inhibit removal of the container when the door is closed while enabling removal when the door is open, to thereby enable an intended recipient to retrieve an article by opening the door and moving the container to a position providing access through the second opening.

2. A device as recited in claim 1, further comprising:

hinge means for attaching the first cover member to the container so that the first cover member can be moved between an open position enabling access through the first opening and a closed position covering the first opening.

3. A device as recited in claim 1, further comprising:

locking means, including a key operated lock mechanism attached to the first cover member, for locking the first cover member in a position covering the first opening.

4. A device as recited in claim 1, further comprising:

a second cover member adapted to be placed on the container over the second opening, to inhibit access through the second opening.

5. A device as recited in claim 4, further comprising:

second hinge means for attaching the second cover member to the container so that the second cover member can be moved between an open position enabling access through the second opening and a closed position covering the second opening.

6. A device as recited in claim 5, wherein:

the second hinge means is disposed on an end portion of the container opposite an end portion to which the bracket is attached, to inhibit movement of the second cover member from the closed position when the container is mounted on the door.

7. A device as recited in claim 1, wherein the container comprises:

a box having a size and shape adapted to contain a conventional video cassette.

8. A device as recited in claim 1, wherein the bracket member comprises:

a generally flat, elongated sheet of material attached to the container, the sheet of material having a U-shaped portion for placement over an edge of the door.

9. A device as recited in claim 1, wherein the bracket member comprises:

a generally flat, elongated sheet of material extending between the first and second ends of the bracket;

a first right angle bend in the sheet generally perpendicular to the longitudinal axis of the sheet and disposed at a first end of the midportion of the bracket toward the first end of the bracket, to define a first offset portion of the bracket;

a second right angle bend in the sheet generally parallel to the first bend and disposed intermediate the first offset portion and the first end of the bracket, to define a second offset portion of the bracket;

a third right angle bend in the sheet generally parallel to the first bend and disposed intermediate the midportion and the second end of the bracket, to define the lip portion of the bracket member; and attachment means for attaching the second offset portion to the container.

10. A device as recited in claim 1, further comprising:

access inhibiting means, including the first offset portion having a size such that the container is retained closely adjacent the door frame, for causing the container to bear against the door frame when the container is moved outwardly from the door so that outward movement and access through the second opening is thereby inhibited.

11. A device in which to place an article to be retrieved later by an intended recipient, comprising:

a container having a first portion defining a first opening through which to insert an article into the container, a second portion defining a second opening through which to retrieve the article from the container, and a size and shape enabling the container to be mounted on a conventional door;

a first cover member adapted to be locked in place on the container in a position disposed over the first opening, to limit access through the first opening;

hinge means for attaching the first cover member to the container so that the first cover member can be moved between an open position enabling access through the first opening and a closed position covering the first opening;

locking means, including a key operated lock mechanism attached to the first cover member, for locking the first cover member in a position covering the first opening;

a second cover member adapted to be placed on the container over the second opening, to inhibit access through the second opening;

second hinge means for attaching the second cover member to the container so that the second cover member can be moved between an open position enabling access through the second opening and a closed position covering the second opening;

support means, including a bracket member having a first end, a second end, and a generally flat midportion disposed intermediate the first and second ends that is shaped and dimensioned to fit between the door and a door frame on which the door is mounted, for providing a support structure with which to mount the container on the door by closing the door with the midportion disposed between the door and the door frame;

mounting means for attaching the first end of the bracket to the container so that with the midportion of the bracket disposed between the door and the door frame, the first opening of the container is disposed in a position enabling placement of an article through the first opening into the container by unlocking the first cover member and the second opening of the container is disposed closely adjacent to and facing the door in a position inhibiting retrieval of the article through the second opening; and door engaging means, including a lip portion of the bracket member disposed intermediate the midportion of the bracket and the second end, for engaging the door to inhibit removal of the container when the door is closed while enabling removal when the door is open, to thereby enable an intended recipient to retrieve an article by opening the door and moving the container to a position providing access through the second opening.

* * * * *

UNITED STATES PATENT AND TRADEMARK OFFICE

CERTIFICATE OF CORRECTION

PATENT NO. : 4,694,668

DATED : 22 September 1987

INVENTOR(S) : Guy D. Ciletti, Michael J. Trudeau

It is certified that error appears in the above—identified patent and that said Letters Patent is hereby corrected as shown below:

Column 6, line 2 "ccntainer" should read --container--;

Signed and Sealed this

Second Day of February, 1988

*Attest:*

DONALD J. QUIGG

*Attesting Officer*

*Commissioner of Patents and Trademarks*